US005481818A

United States Patent [19]

Stover

[11] Patent Number: 5,481,818

[45] Date of Patent: Jan. 9, 1996

[54] GUN SIGHT MOUNTING SYSTEM

[75] Inventor: Gerald E. Stover, Lapeer, Mich.

[73] Assignee: Williams Gunsight Company, Davison, Mich.

[21] Appl. No.: 353,054

[22] Filed: Dec. 9, 1994

[51] Int. Cl.[6] ..... F41G 1/26

[52] U.S. Cl. ..... 42/100; 33/260

[58] Field of Search ..... 42/100; 33/254, 33/257, 260, 252, 258, 259, 261

[56] References Cited

U.S. PATENT DOCUMENTS

| | | | |
|---|---|---|---|
| 466,599 | 1/1882 | Carver . | |
| 658,709 | 9/1900 | Fischer . | |
| 807,812 | 12/1905 | Elterich | 33/257 |
| 874,914 | 12/1907 | Norman | 33/257 |
| 1,167,490 | 1/1916 | Gilmore . | |
| 1,220,637 | 3/1917 | Johnson . | |
| 1,229,652 | 6/1917 | Paulson | 33/260 |
| 1,896,926 | 2/1933 | Frommer | 33/260 |
| 2,044,855 | 6/1936 | Lundgreen | 33/257 |
| 2,112,268 | 3/1938 | Burton . | |
| 2,276,446 | 3/1942 | Zimmerman . | |
| 2,407,437 | 9/1946 | Mossberg . | |
| 2,438,601 | 3/1948 | Davis . | |
| 3,838,522 | 10/1974 | Williams | 33/258 |
| 4,200,989 | 5/1980 | Brouthers | 33/257 |
| 4,536,966 | 8/1985 | Engel | 33/257 |
| 4,606,131 | 8/1986 | Domain | 42/100 |
| 5,063,677 | 11/1991 | Millett | 33/252 |
| 5,208,407 | 5/1993 | Stover | 42/102 |

FOREIGN PATENT DOCUMENTS

| | | | |
|---|---|---|---|
| 116152 | 4/1946 | Sweden | 33/252 |
| 138435 | 12/1952 | Sweden | 33/252 |
| 94036 | 8/1922 | Switzerland | 33/252 |
| 402669 | 11/1965 | Switzerland | 42/100 |

*Primary Examiner*—Stephen M. Johnson
*Attorney, Agent, or Firm*—Harness, Dickey & Pierce

[57] ABSTRACT

The present invention relates to a gun sight assembly mounting system for a firearm such as a rifle. The gun sight assembly mounting system includes a housing, a selectively compressible spring member, a mounting base, a selectively detachable sight embodiment and an elevation screw. Both the mounting base and the sight embodiment can be raised or lowered as desired by rotating the elevation screw to assist in obtaining a target line. Windage adjustability is also obtained through horizontal movement of the sight blade.

10 Claims, 1 Drawing Sheet

GUN SIGHT MOUNTING SYSTEM

BACKGROUND OF THE INVENTION

I. Technical Field

The present invention relates to gun sight mounting systems, and more particularly to rear gun sight system assemblies for firearms such as rifles and the method of using the gun sight assemblies disclosed herein.

II. Description of Related Art

Almost all firearms including rifles, shot guns and pistols include some form of sighting device for acquiring a target line. The sighting device typically comprises a pair of sights, one located proximate to the front and the other disposed proximate to the rear of the firearm along the top portion of the barrel. By positioning the gun such that a target line between the object, the forward sight and rear sight is attained a greater likelihood of hitting the desired target is achieved.

Unfortunately, many of the gun sights in use today are unduly complicated and do not allow for interchangeably between various gun sight embodiments. Additionally, as is known by hunters and sportsman alike, it is highly desirable to provide the rear sight with both vertical and windage adjustability, so that the firearm can be precisely aligned with the target.

Thus, there is a need for easily attachable and detachable sight assemblies which can be employed on rifles as either original equipment or replacement components for firearms provided with another sight assembly at the time of manufacture.

SUMMARY OF THE INVENTION

In accordance with these goals and objectives, the present invention relates to gun sight system assemblies for firearms such as rifles. The gun sight system assembly includes a housing attached along the top surface of the gun barrel, an elongated base plate which includes a recess for receiving the base portion of the gun sight itself, means for securing the gun sight to the base plate at the desired location and means for adjusting the sight assembly side to side, generally referred to as windage.

Thus, it is the primary object of the present invention to provide a gun sight assembly which is easily attached and detached from the gun.

It is a further object of the present invention to provide a gun sight assembly which allows for the use of various differing gun sight embodiments such as blade and aperture type sights with a common mounting base.

It is yet another object of the present invention to provide a gun sight assembly which is inexpensive to manufacture.

These and other advantages of the present invention will be more readily apparent when considered in reference to the following description and when taken in conjunction with the accompanying drawings.

DETAILED DESCRIPTION OF THE PREFERRED EMBODIMENT

Figure 1:
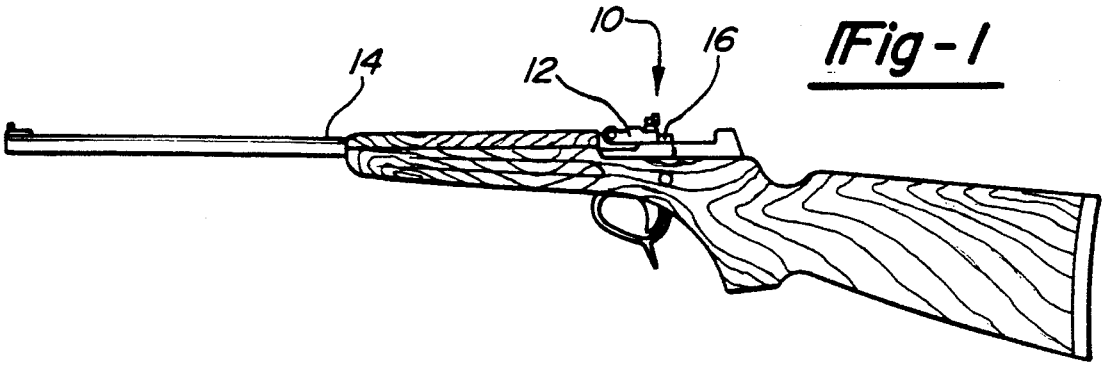
FIG. 1 is a side elevational view of a rifle including a forward gun sight and a rear gun sight assembly, according to the teachings of the present invention.

In accordance with the teachings of the present invention, there is provided a gun sight mounting system, generally shown at reference 10. The gun sight mounting system 10 is generally utilized as the rear gun sight assembly 12 located along the top of the gun barrel. Referring to FIGS. 1–6, the gun sight mounting system, which is useful as either an original rear gun sight assembly mounted at the time of manufacture or more typically as a replacement for various military rear gun sight assemblies such as the foreign manufactured SKS series rifle includes a rear sight housing 20 which is mounted along the top of the gun barrel 14 proximate to the rear 16 of the barrel. The housing 20 includes a transverse blocking wall 22 extending upwardly along the rear portion 24 of the housing upwardly extending side walls 26 and 26A spaced apart along both sides of the forward end 28 of the housing, an elongated floor 30 and a relatively short shelf 32 which overhangs a portion of the floor 30 to provide a detent 34. Extending transversely between the side walls 26 and 26A is a selectively removable roll pin 36.

The gun sight mounting system 10 also includes a spring member 38 (shown most clearly in FIG. 4) preferably made from a resilient metal such as high spring stainless steel. The spring member 38 is attached to the housing 20 by seating a relatively flat second end 40 of the spring in the detent 34 provided between the side walls on the housing 20. Spring member 38 which is offered as an original part on the SKS series 7.62×39 rifle, also includes an upwardly extending, slightly arcuate first end 42 upon which a mounting base 44 comes to rest.

The mounting base 44 includes a relatively thin elongated first end 46 and thicker second end 48. Typically, the mounting base 44 is positioned within the housing 20 between the side walls such that the first end 46 rests upon the upwardly extending first end 42 of spring member 38 and the second end 48 rests upon the shelf 32 disposed along the rear portion of the housing. Ideally, the first end 46 includes a transversely disposed groove 50 located along its top surface 52 for receiving the roll pin 36 extending between the side walls 26 and 26A of the housing 20.

Figure 3:
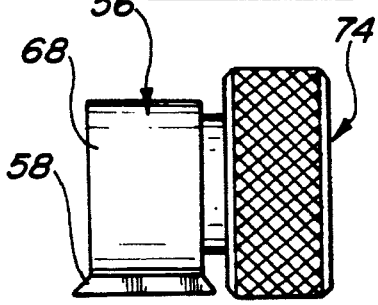
FIG. 3 is a side elevational view of the rear gun sight of FIG. 2.
Figure 4:
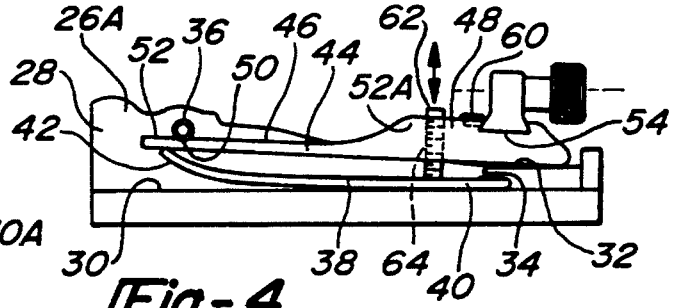
FIG. 4 is a perspective view of a second rear gun sight assembly according to the teachings of the present invention.
Figure 6:
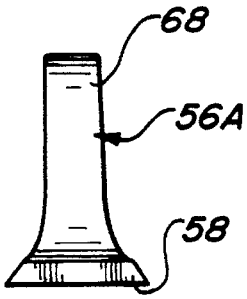
FIG. 6 is a sectional side view taken along line A—A of FIG. 4 illustrating the gun sight assembly as attached to the barrel of a rifle.

The thicker second end 48 of the mounting base 44 includes a recess means 54 extending from the top surface 52A thereof for receiving the base portion 58 of the respective gun sight embodiment 56 or 56A as illustrated in FIGS. 3 and 6, respectively, and as will be described in greater detail below. While the recess means 54 may have any one of a number of configurations, it has been discovered that a dovetail geometry tends to allow for the desired ready attachment and selectively detachment of the gun sight embodiment. Thus, the gun sight embodiment 56 or 56A will have a corresponding base portion geometry to mate with the geometry of the recess means.

The gun sight mounting system 10 also includes a selectively adjustable windage screw 60 which is positioned adjacent the forward edge of the gun sight embodiment's base portion 58 thus allowing the marksman to secure the gun sight embodiment 56 or 56A.

Located still more forward along the second end 48 of the mounting base 44 is an elevation screw 62 which extends through a threaded aperture 64. Preferably, the elevation screw 62 extends from the top surface 52A to the floor 30 of the housing 20. Ideally, the elevation screw 62 is sufficiently long to contact the second end of the spring member 38. It is important that the elevation screw 62 not be too long so as to obstruct the view through the gun sight embodiment 56 or 56A, but be sufficiently long so as to contact the spring member 38.

Figure 5:
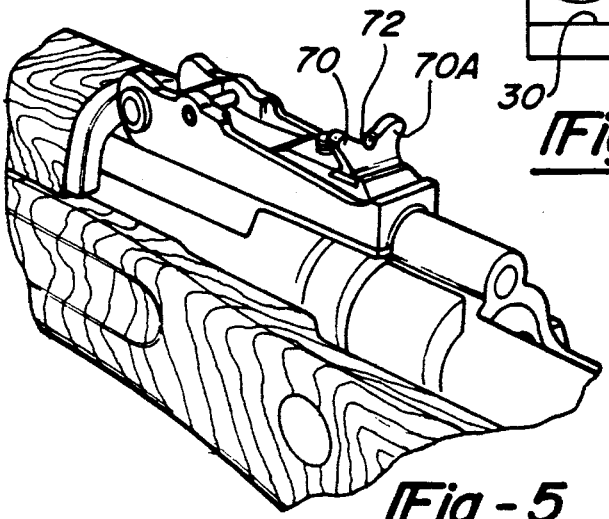
FIG. 5 is a side elevational view of the rear gun sight of FIG. 4.

With regard to the gun sight embodiments 56 and 56A, respectively, the open sight 56A is typically of the blade variety as illustrated most clearly in FIG. 5 and includes a base portion 58 which corresponds to the geometry of the recess means 54 and a head portion 68 which includes outwardly protruding wings 70 and 70A. Located between the wing portions, 70 and 70A, respectively is a sight hole 72 through which the target line is formed.

Figure 2:
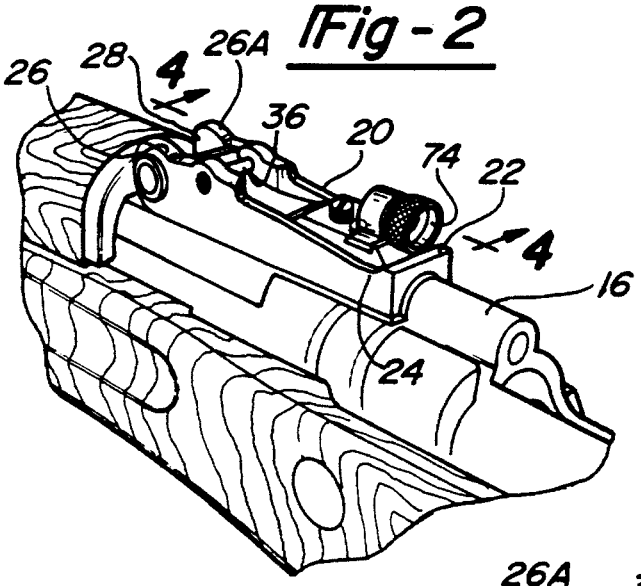
FIG. 2 is a perspective view of a first rear gun sight assembly according to the teachings of the present invention.

Under an optional embodiment, the gun sight 56 as illustrated most clearly in FIG. 2 also includes a base portion 58 and a head portion 68 which is provided with a special large hole aperture 74 preferably having a radius of approximately ⅜ of an inch and a depth of approximately 0.150 inches which allows for an enhanced field of view.

By way of example, assembly and disassembly of the gun sight system will now be described in greater detail. Initially, the spring member 38 is attached such that the second end 40 seats within the detent 34 provided along the rear of the housing 20. Thereafter, the roll pin 36 is inserted through the apertures provided on the side walls to extend transversely between the side walls. The elongated first end 46 of the mounting base 44 is then slid under the roll pin 36 by compressing the first end 42 of the spring member 38. Once the transverse groove 50 provided on the forward end of the mounting base is engaged by the roll pin 36, the second end 48 of the mounting base is positioned to rest upon the shelf 32 provided along the rear portion of the housing. Preferably, the second end 48 of the mounting base rests closely to the upwardly extending blocking wall 24 to assist in maintaining attachment of the assembly.

After the spring member 38 and mounting base 44 have been positioned within the housing 20, the elevation screw 62 is attached such that the first end rests on the spring member 38 and the second end is accessible from the top surface 52A of the mounting base. To adjust the elevation of the gun sight embodiment 56 or 56A, respectively, the elevation screw 62 can be rotated to either raise or lower the elevation of the mounting base which in turn causes the gun sight embodiment to be raised or lowered as desired.

Typically although not essentially, the interchangeable gun sight embodiment 56 and 56A is attached to the mounting base 44 after the mounting base has been attached to the housing. By loosening the windage screw 60, the base portion 58 of the gun sight embodiment 56 or 56A can be slid into the recess means 54 and thereafter secured by tightening the windage screw such that the head of the windage screw seats against the base portion of the gun sight embodiment.

While the above description constitutes the preferred embodiments of the present invention, it is to be appreciated that the invention is susceptible to modification, variation and change without departing from the proper scope and fair meaning of the accompanying claims.

What is claimed is:

1. A gun sight mounting system comprising:

a housing including upwardly extending spaced apart side walls, an elongated floor and a shelf portion disposed above said floor;

a spring member having a relatively flat second end disposed along said floor and an upwardly extending arcuate first end;

an elongated mounting base having a first end which is retained between said first end of the spring member and a roll pin and a second end which is disposed on said shelf portion said second end of the mounting base including recess means for receiving a selectively interchangeable sight embodiment; and an elevation screw which extends through said mounting base to contact said spring member;

whereby upon rotating the elevation screw the mounting base and sight embodiment can be simultaneously raised or lowered as desired, wherein said shelf portion at least partially overlaps the floor of said housing to provide a detent for receiving the second end of said spring member.

2. The gun sight assembly mounting system of claim 1, wherein said first end of the mounting base includes a transversely disposed groove for receiving a portion of the roll pin upon attachment of said mounting base to said housing.

3. The gun sight assembly mounting system of claim 1, wherein said selectively interchangeable sight embodiment includes a base portion which seats within the recess means provided on said mounting base.

4. The gun sight assembly mounting system of claim 3, wherein said base portion and said recess means have a complimentary dove tail geometry.

5. The gun sight assembly mounting system of claim 1, wherein said housing includes an upwardly extending transverse blocking wall to assist in precluding an undesired withdrawal of said mounting base from said housing.

6. A gun sight assembly mounting system, comprising:

a housing including upwardly extending spaced apart side walls having a roll pin extending therebetween and a shelf portion which overhangs a portion of an elongated floor to provide a detent located below said shelf portion;

a spring member having a relatively flat second end which seats within said detent and an upwardly extending arcuate first end;

a mounting base having a first end which is retained between the first end of said spring member and said roll pin and a second end which is positioned on said shelf, said second end of the mounting base including recess means for receiving a selectively interchangeable sight embodiment; and an elevation screw which extends through the second end of the mounting base to engage said spring member;

whereby upon rotating the elevation screw the second end of the mounting base and the sight embodiment can be simultaneously raised or lowered as desired.

7. The gun sight assembly mounting system of claim 6, wherein said first end of the mounting base includes a transversely disposed groove for receiving a portion of the roll pin upon attachment of said mounting base to said housing.

8. The gun sight assembly mounting system of claim 6, wherein said sight embodiment includes a base portion having a geometry which fittingly corresponds to the geometry of said recess means.

9. The gun sight assembly mounting system of claim 6, wherein said housing includes an upwardly extending transverse blocking wall which assists in precluding an undesired withdrawal of said mounting base from said housing.

10. A gun sight mounting system comprising:

a housing including an elongated floor, upwardly extending spaced apart side walls disposed along a first end, a transversely disposed upwardly extending blocking wall disposed along a second end and a shelf disposed along said second end which partially overlaps said floor to provide a detent;

a selectively removable roll pin extending between said spaced apart side walls;

a spring member having a relatively flat second end which is disposed along the floor of said housing and which seats within said detent and an upwardly extending slightly arcuate first end;

a selectively interchangeable sight embodiment including a base portion and a head portion;

an elongated mounting base having a first end which rests upon said spring member and a second end which rests upon said shelf, said first end of said mounting base including a transverse groove for receiving a portion of said roll pin and said second end of said mounting base including transversely disposed dove tail recess means for receiving the base portion of said sight embodiment;

and an elevation screw which extends through the second end of said mounting base to engage the spring member;

whereby upon rotating the elevation screw, the second end of the mounting base and the sight embodiment can be simultaneously raised or lowered as desired.

* * * * *